US009889971B2

(12) United States Patent
Luzzato et al.

(10) Patent No.: US 9,889,971 B2
(45) Date of Patent: Feb. 13, 2018

(54) STOPPER DEVICE FOR THE NECK OF A CONTAINER, CONTAINER PROVIDED WITH SUCH A DEVICE, METHOD FOR STOPPING SUCH A CONTAINER, AND METHOD FOR PRODUCTION OF SUCH A DEVICE

(75) Inventors: Michel Luzzato, Lyons (FR); Gregory Antier, Trevoux (FR)

(73) Assignee: SOLOCAP-MAB S.A., Contrexville (FR)

( * ) Notice: Subject to any disclaimer, the term of this patent is extended or adjusted under 35 U.S.C. 154(b) by 1480 days.

(21) Appl. No.: 11/919,432

(22) PCT Filed: May 12, 2006

(86) PCT No.: PCT/FR2006/001076

§ 371 (c)(1),
(2), (4) Date: Oct. 26, 2007

(87) PCT Pub. No.: WO2006/120358

PCT Pub. Date: Nov. 16, 2006

(65) Prior Publication Data

US 2009/0301987 A1 Dec. 10, 2009

(30) Foreign Application Priority Data

May 13, 2005 (FR) ..... 05 04830

(51) Int. Cl.
*B65D 39/00* (2006.01)
*B65D 41/00* (2006.01)
(Continued)

(52) U.S. Cl.
CPC ..... *B65D 41/045* (2013.01); *B65D 41/3423* (2013.01); *B65D 41/62* (2013.01)

(58) Field of Classification Search
CPC ..... B65D 41/3438; B65D 41/0492; B65D 41/0464; B65D 41/0457; B65D 41/0435; B65D 41/325; B65D 41/3423
(Continued)

(56) References Cited

U.S. PATENT DOCUMENTS 3,066,820 A * 12/1962 Faulstich ..... 215/320
3,428,202 A * 2/1969 Asmus ..... B65D 41/0442 215/270

(Continued)

FOREIGN PATENT DOCUMENTS

EP 0 592 721 4/1994
FR 1 372 671 9/1964

(Continued)

*Primary Examiner* — Andrew T Kirsch
(74) *Attorney, Agent, or Firm* — Finnegan, Henderson, Farabow, Garrett & Dunner, L.L.P.

(57) ABSTRACT

The invention relates to a stopper device with an external cap made from plastic and an internal insert for fixing the device around the neck of the container. The sleeve of the cap forms a head, into which the insert may be introduced and permanently fixed and a skirt extending axially from the insert. According to the invention, contamination on the neck of the container may be limited and the appearance improved. Particularly at the base of the neck, the skirt essentially forms a frustum converging towards the axis of the sleeve on extending from the head, before the installation of the device around the neck, the frustum forming, at the end opposite the head, an internal surface to come into contact against the container neck under the influence of an elastic deformation of the sleeve as a result of the installation of the device around the neck.

20 Claims, 2 Drawing Sheets

Figure 1:
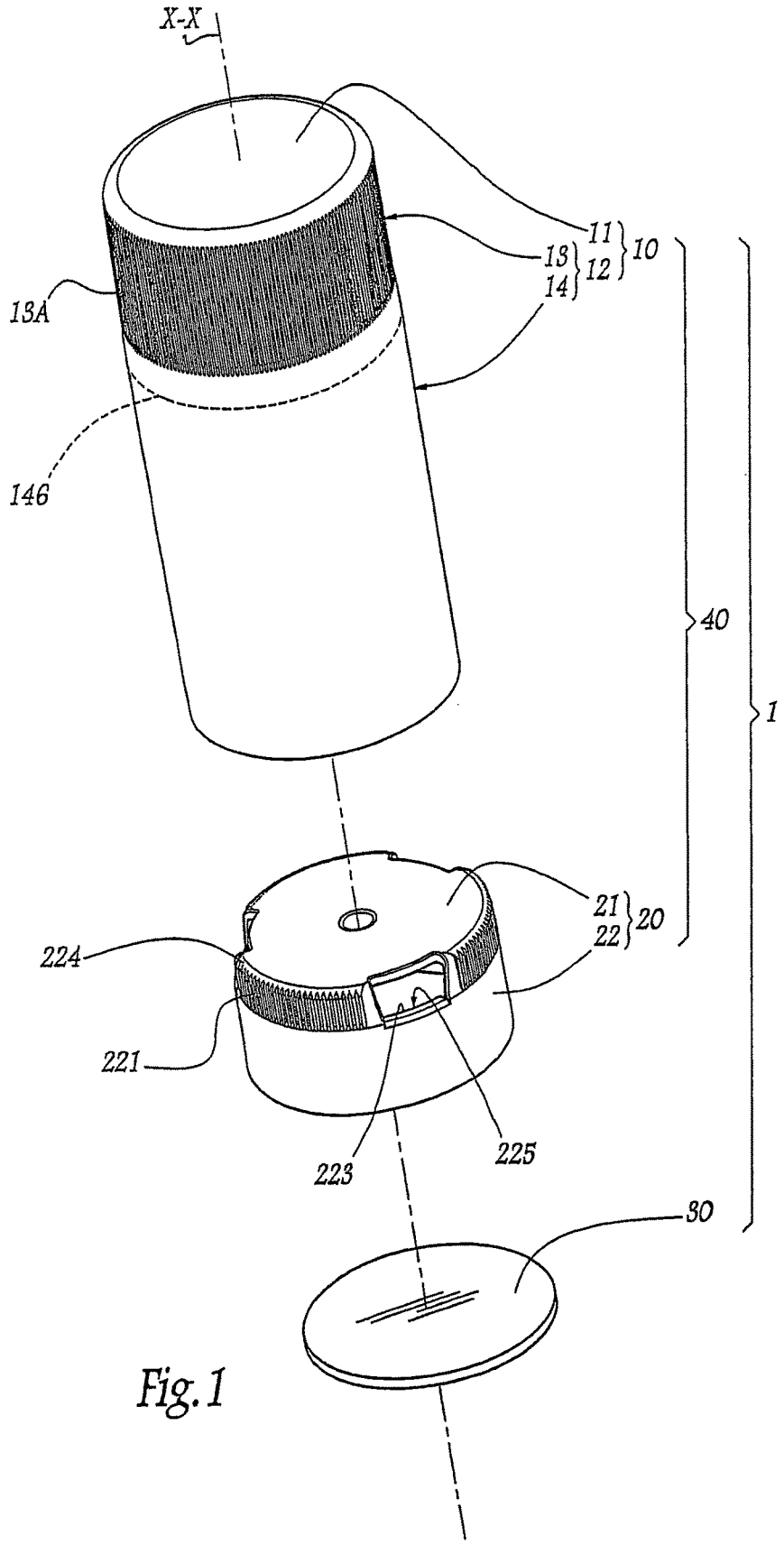

(51) Int. Cl.

| | |
|---|---|
| ***B65D 43/00*** | (2006.01) |
| ***B65D 47/00*** | (2006.01) |
| ***B65D 51/00*** | (2006.01) |
| ***A47J 37/10*** | (2006.01) |
| ***B65D 41/34*** | (2006.01) |
| ***B65D 41/32*** | (2006.01) |
| ***B65D 41/04*** | (2006.01) |
| ***B65D 41/62*** | (2006.01) |

(58) Field of Classification Search
USPC ..... 215/21, 252, 258, 253; 220/292, 295
See application file for complete search history.

(56) References Cited

U.S. PATENT DOCUMENTS 3,587,898 A * 6/1971 Northup ..... 215/252
4,378,893 A * 4/1983 Wilde et al. ..... 215/246
4,458,817 A * 7/1984 Guala ..... 215/21
4,550,845 A * 11/1985 Guala ..... 215/252
4,801,030 A * 1/1989 Barriac ..... B65D 41/3428 215/252
4,884,707 A * 12/1989 Crisci ..... 215/256
5,251,796 A * 10/1993 Shelhart ..... 224/454

FOREIGN PATENT DOCUMENTS

| | | |
|---|---|---|
| FR | 2 267 952 | 11/1975 |
| JP | 129251 | 6/1937 |
| JP | 52114953 | 2/1952 |
| JP | 4531912 | 12/1970 |
| JP | 6293349 | 10/1994 |
| JP | 2001253452 | 9/2001 |
| JP | 200381302 | 3/2003 |
| WO | WO 00/07898 | 2/2000 |
| WO | WO 00/63089 | 10/2000 |

* cited by examiner

STOPPER DEVICE FOR THE NECK OF A CONTAINER, CONTAINER PROVIDED WITH SUCH A DEVICE, METHOD FOR STOPPING SUCH A CONTAINER, AND METHOD FOR PRODUCTION OF SUCH A DEVICE

The present invention relates to a closure device for closing a receptacle neck, and to a receptacle fitted with such a device, and also to a method of closing a receptacle by means of such a device, and to a method of manufacturing such a device. The invention relates particularly, but not exclusively, to glass receptacles for containing an alcoholic beverage, in particular wine.

Traditionally, wine bottles are closed by means of a plug that is made of cork and that is jammed in the neck of the bottle, and that is subsequently covered in a metal covering, generally a sheet of aluminum fitting closely to the outside shape of the neck.

In order to make it easier to open glass bottles, and above all to reclose them, proposals have been made in the past to replace corks with removable metal closures, generally suitable for being screwed onto the neck and then unscrewed. Sealing is obtained by means of a sealing piece, in practice a disk, that is retained inside the closure, close to its end wall. Such metal closures frequently comprise a screw cap and a collar that is held in place around the base of the neck of the bottle, with frangible metal bridges connecting the cap to the collar before first opening of the bottle. The collar remains in place at the base of the neck, and depending on its dimensions and/or its coloring, it can impart an attractive appearance to the neck of the bottle. Nevertheless, such metal closures are relatively dangerous for the user who runs the risk of getting cut while handling them.

In FR-A-1 372 671, EP-A-0 592 721, FR-A-2 267 952 and WO-A-00/07898, proposals have been made for closures made of plastics material, in the form of a relatively flexible cap, commonly referred to as a "capsule", in the end of which a sealing gasket can be housed, so as to be received inside the neck of a bottle, while the skirt of the capsule covers the outside of the neck. In principle, the flexibility of the skirt enables the capsule to fit closely to the outside face of the neck. However, in practice, the skirts of such capsules are designed to be circular cylinders such that when the necks for closing present an elaborate shape, or when, for some given shape, such necks suffer from dispersion concerning their outlines, the effect of the capsule fitting "closely" around the neck is not obtained. In addition, that kind of flexible capsule, which is torn on first opening, is not suitable for being replaced at will around the neck in order to reclose it.

WO-A-00/63089 proposes a closure device having three main components, namely an outside capsule, an inside insert held stationary permanently inside the capsule, and a sealing disk retained in the insert. The insert is designed to enable the device to be screwed on and off a receptacle neck, thus enabling it to be opened and reclosed at will, while the outer capsule is specifically dedicated to providing a pleasing appearance for the device, by completely masking the insert. Thus, WO-A-00/63089 envisages capsules that are rigid, whether made of plastics material, or made of metal, with the above-mentioned problems of potential cuts. Either way, the capsules comprise a tubular sleeve of circular base constituted by a cap for housing the insert and an end collar extending axially beyond the insert towards the base of the neck of the receptacle. Nevertheless, the appearance of the collar in those devices is not very attractive because the collar is designed to adapt to receptacle necks having bases presenting a variety of shapes, or for, some given shape, presenting relatively great dispersion concerning their outlines. In practice, the collars of those devices are generally circular cylinders presenting an axial dimension that is small so as to avoid any contact with, and any jamming between, the rigid outside capsule and the neck of the glass receptacle. The resulting gap between the closure device and the base of the neck runs the risk of enabling dirt or germs to accumulate on the collar of the outside capsule, leading to corresponding advantages in terms of health and appearance.

The object of the present invention is to propose a closure device having an inside insert for releasably fastening around a neck of the receptacle and an outside capsule of plastics material which, in particular at the base of the neck of the receptacle for closing, limits the risk of the inside of the capsule being dirtied, and presenting improved appearance, in particular by seeking to imitate the above-mentioned metal closures, even when the dimensions of the receptacle necks for fitting with the device presents a certain amount of dispersion concerning their shape.

To this end, the invention provides a closure device for closing a receptacle neck, as defined in claim 1.

A closure device of the invention can thus cover a receptacle neck over the main part of its length: the free end portion of the neck is surrounded by the cap of the sleeve of the capsule, that permanently houses the insert that is releasably connected to said end portion of the neck, while the opposite end portion of the neck, i.e. its base that is connected to the main body of the receptacle, is covered by the skirt. No radial clearance remains, remote from the cap, between the neck and the end of the truncated cone formed by the skirt due to the inside surface of said end pressing against the neck. In other words, the truncated cone fits closely and elastically around the outside shape of the neck, automatically accommodating any potential dimensional tolerances at the base of the neck. No dirt can thus infiltrate between the neck and the capsule from this end of the truncated cone. In addition, the appearance of the skirt is then similar to that of the metal collars of metal closures as mentioned above. In addition to giving the skirt the elasticity that enables it to accommodate variations in the dimensions of the neck, the fact of making the outside capsule out of plastics material limits the risk of the user being cut, or more generally, injured while handling the closure device of the invention. In addition, for receptacles made of glass, the presence of plastics material around the neck of the receptacle does not lead to any significant impediment in recycling the glass that constitutes the receptacle, since the plastics material can be mixed without problem with the glass melt during glass recycling, unlike closure devices that include metal.

Other characteristics and advantages of the device, taken in isolation or in any technically feasible combination, are set out in dependent claims 2 to 6.

The invention also provides a receptacle including a neck adapted to be closed by a closure device as defined above. The receptacle is advantageously made of glass.

The invention also provides a method according to claim 9 for closing a receptacle neck by means of a device as defined above.

The invention also provides a method as defined in claim 10 for manufacturing a closure device for closing a receptacle neck.

The method of the invention thus makes it possible firstly to obtain the outside capsule of plastics material quickly, and secondly to assemble the closure device easily, the device subsequently being manipulated just as easily for fitting removably around the neck of the receptacle, e.g. by screw fastening. Since the various operations of the method of manufacture of the invention, both in terms of molding and in terms of assembling the various components of the device, are suitable for being implemented using movements that are substantially axial, the method is suitable in practice for being automated, without degrading the quality of its performance.

Figure 2:
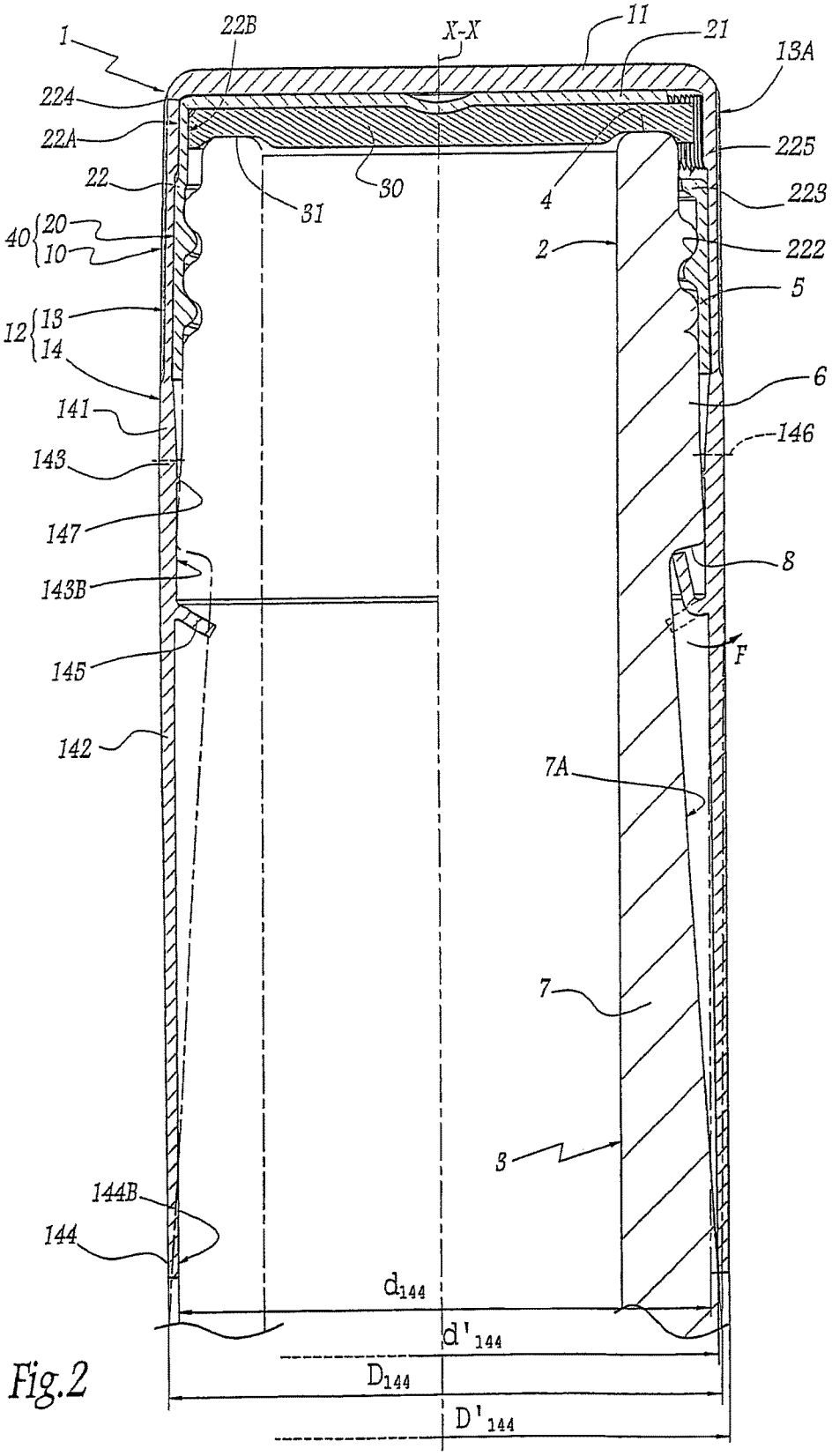

The invention can be better understood on reading the following description given purely by way of example and made with reference to the drawings, in which:

FIG. 1 is an exploded perspective view of a closure device of the invention; and FIG. 2 is a longitudinal section of the FIG. 1 device shown around a receptacle neck, the left-hand half of the figure showing the device in the assembled state but not yet put into place around the neck, while the right-hand half of the figure shows the device assembled and put into place around the neck so as to closure it.

In FIGS. 1 and 2, there can be a closure device 1 adapted to be screwed in releasable manner on a neck 2 of a receptacle 3, e.g. a bottle made of glass or the like, for containing an alcoholic beverage, in particular wine. The neck 2 presents a generally tubular shape about a longitudinal axis X-X.

For convenience, in the description below, orientations assume that the terms "top" and "high" correspond to a direction generally parallel to the axis X-X and going away from the neck 2, i.e. in a direction that is directed towards the top portions of FIGS. 1 and 2, whereas the terms "bottom" and "low" correspond to an opposite direction.

At its free end, the neck 2 defines a rim 4 over which the liquid contained in the receptacle is to be poured. The outside face of the neck 2 is provided, in succession on going downwards from the top with: a helical thread 5 and with a ring 6, both projecting radially outwards. At the transition between the bottom end of the ring and the remainder of the neck 2, which constitutes an elongate portion 7, there is formed a transverse shoulder 8 that slopes a little relative to a plane perpendicular to the axis X-X. The outside face 7A of the elongate portion 7 is substantially frustoconical about the axis X-X and it converges towards the shoulder 8.

The closure device 1 essentially comprises three distinct parts, namely a capsule 10, an insert 20, and a sealing disk 30 that are designed to be assembled coaxially one within the other and then mounted on the neck 2. In the assembled state, the capsule 10 and the insert 20 form a one-piece closure 40, as explained below.

The capsule 10 and the insert 20 are both generally tubular in shape about a longitudinal axis that coincides substantially with the axis X-X when the device 1 is assembled and fitted on the neck 2, as shown in FIG. 2. The capsule and the insert are both open at their bottom ends and closed at their top ends by respective end walls 11 and 21, respectively with a tubular sleeve 12 and a tubular skirt 22 centered on the axis X-X and extending axially downwards from the peripheries of the end walls 11 and 21.

The insert 20 is adapted to be inserted inside the capsule 10 so as to be held stationary therein permanently, both axially and in rotation about the axis X-X, thus forming the closure 40. For this purpose, the top end portion of the sleeve 12 of the capsule 10 forms a cap 13 for housing the insert 20 and holding it stationary, with the length of said cap, i.e. its dimension along the axis X-X, being substantially equal to the length of the insert 20. The remainder of the sleeve 12, i.e. the portion of the sleeve situated below the axial level of the bottom end of the insert 20 when housed in the cap 13, forms a skirt 14 described in greater detail below. The capsule 10 comprises a single piece.

In order to prevent the insert 20 from moving in rotation inside the cap 13, the outside face 22A of the skirt 22 of the insert is provided with a plurality of longitudinal splines 221 projecting radially outwards and distributed around the periphery of the insert. These splines are dimensioned to engage with complementary longitudinal grooves in the inside face 13B of the cap 13.

The insert 20 is prevented from moving axially inside the cap 13 in an upward direction by the end wall 11 of the capsule 10, and in a downward direction by the top end portion 141 of the skirt 14 that has a shoulder directed inwards relative to the bottom end of the cap 13. This shoulder need not present a radial dimension that is large relative to the thickness of the skirt 22 of the insert, providing the insert jams radially inside the cap of the capsule 10 with sufficient intensity when the insert is put into place. In this respect, in a variant that is not shown, this shoulder may be omitted.

The skirt 22 of the insert 20 also defines an inside face 22B provided in its bottom portion with a thread 222 that projects radially inwards and that is substantially complementary to the outside thread 5 on the neck 2, such that the closure 40, i.e. the insert and the capsule 10 when assembled together, is suitable for being screwed on and off the neck 2. In order to make the closure easier for the user to grip in the hand, the outside face 13A of the cap 13 has longitudinal grooves.

In its top portion, the inside face 22B of the skirt 22 of the insert 20 is provided with three radially inwardly projecting lips 223 distributed around the periphery of the skirt 22 between zones 224 where the skirt connects with the end wall 21 of the insert. One of these connection zones 224 is shown in section in the left-hand portion of FIG. 2, while the right-hand portion of FIG. 2 shows that the corresponding zones of the skirt 22 that extend over the lips 22 are open. Each lip 223 thus defines a top face 225 that is substantially plane. The three faces 225 lie substantially in the same plane perpendicular to the axis X-X and thus constitute a downward axial support for the disk 30.

Extending axially downwards from its top end portion 141, the skirt 14 forms a truncated cone 142 centered on the axis X-X and converging downwards.

The top end portion 143 of the truncated cone 142, i.e. the more widely flared of the two axial end portions of this truncated cone, presents a shape that is generally cylindrical and of inside diameter $d_{143}$ that is substantially equal to the maximum outside diameter of the ring 6 of the neck 2. As a result, when the closure device 1 is fitted around the neck 2, the inside face 143B of this flared end portion 143 is pressed into contact with the maximum-diameter zone of the ring 6, as shown in the right-hand portion of FIG. 2.

At the bottom end 144 of the truncated cone 142, i.e. at the more tapered end of the two axial ends of this truncated cone, the inside diameter $d_{144}$ of the skirt is smaller than the outside diameter of the zone of the elongate portion 7 at the axial level where said end 144 is to extend when the device 1 has been put into place around the neck 2. As a result, while the device is being put into place, the inside diameter of the end 144 increases by elastically deforming the sleeve 12 and takes on a value $d'_{144}$ that is substantially equal to the diameter of the associated zone on the outside face 7A of the elongate portion 7 of the neck 2. Since the thickness of the wall of the truncated cone 142 is substantially constant along its length, the outside diameter of the end 144 goes from a value $D_{144}$ when the device 1 has not yet been assembled on the neck 2, to a greater value $D'_{144}$ once the device 1 is in place. The corresponding increase in the cross-section of the end 144 of the truncated cone 142 leads to a reduction in the conicity of this truncated cone, i.e. to a reduction in the angle at its apex. In other words, when the device 1 is put into place around the neck 2, the frustoconical shape of the portion 142 of the skirt 14 tends towards a circularly cylindrical shape, without necessarily reaching that shape, depending on the dimensions of the skirt and the dimensions of the neck 2. As a result the inside face 144B of the end 144 of the truncated cone 142 presses radially and elastically against the corresponding zone of the outside face 7A of the portion 7 of the neck 2, without leaving any clearance between these faces.

In practice, while the device 1 is being put into place around the neck 2, the truncated cone 142 is deformed outwards, with its top end portion 143 in contact with the ring 6 of the neck 2 forming a kind of hinge for the bottom portion of the truncated cone 142, which tilts about said hinge, as represented by arrow F. The deformed configuration of the truncated cone is drawn in continuous lines in the right-hand portion of FIG. 2, while its initial configuration is drawn therein in dashed lines.

In addition, unlike the cap 13 connected to the end wall 11 and in which the insert 20 is held stationary when the device 1 is in the assembled state, the skirt 14 presents a certain amount of flexibility that makes the above-described deformation possible and that imparts a certain amount of structural elasticity thereto, tending to return the truncated cone 142 to its initial configuration. As a result, the surface 144B is held pressed against the outside face 7A of the portion 7 of the neck 2.

In its main portion, the truncated cone 142 of the skirt 14 is provided with a tongue 145 that projects from its inside face, which tongue may optionally be discontinuous around the inside periphery of the ring. Before the device 1 has been put into place around the neck 2, the tongue extends downwards towards the axis X-X, as shown in the left-hand portion of FIG. 2, whereas once the device 1 has been put into place it extends upwards towards the axis, as shown in the right-hand portion of FIG. 2. Once the device 1 has been fitted onto the neck 2, the free end of the tongue 145 is situated immediately under the shoulder 8, such that when the closure 40 is unscrewed upwards for the first time, the tongue comes to bear against the shoulder, thus preventing the bottom portion of the skirt 14 moving axially, while the remainder of the skirt, together with the cap 13 and the end wall 11 can be taken away upwards. For this purpose, a line of weakness 146 as represented by dashed lines in FIGS. 1 and 2 is provided in the main portion of the skirt 14, axially above the tongue 145. In the example shown, the line of weakness 146 is situated axially over the zone where the end portion 141 connects with the truncated cone 142. This line of weakness is constituted by breakable bridges, for example, or by a plurality of circumferential cuts or nicks formed through the wall of the skirt.

The top end portion 143 of the truncated cone 142 is provided internally, axially juxtaposed with the line of weakness 146, with an annular bead 147 extending around the entire inside periphery of said end portion 143. This bead bears in leaktight manner against the outside face of the ring 6 of the neck 2, and thus prevents any drops of liquid coming from the rim 4 and trickling along the thread 5 from infiltrating between the portion 7 of the neck and the portion of the skirt 14 that remains behind when the line of weakness 146 is broken. The presence of this bead 147 in the immediate proximity of the line of weakness also avoids leaving any radial clearance between the end portion 143 of the truncated cone 142 and the ring 6, which would spoil the appearance of the portion of the device 1 that remains around the neck 2 after opening.

The capsule 10 is made of a semirigid plastics material such as polypropylene or polyethylene, with polypropylene being preferred, in particular for reasons of appearance. The capsule is obtained by molding the plastics material, and is designed to constitute simultaneously the cap 13 and the skirt 14, in particular including its truncated cone 142. Unmolding the capsule needs to take account of the undercut inside face of the truncated cone such that the capsule 10 is, advantageously, manipulated only in the vicinity of its end wall 11 in order to be extracted from the mold, providing the truncated cone 142 is suitably dimensioned.

In order to make the capsule easier to unmold, it should be observed that, on extraction from the mold, the tongue 145 extends in the configuration shown in the left-hand portion of FIG. 2, i.e. its free end is directed downwards.

There follows a description of how the closure device 1 is assembled and how it is put into place around the neck 2.

Initially, the capsule 10 is available in its state as extracted from the mold as described above, together with the insert 20 and the sealing disk 30.

In a first step, the sealing disk 30 is placed inside the insert 20 so that the disk is placed axially between the faces 225 of the lips 223 and the end wall 21, with it being necessary to deform the disk a small amount. The disk then rests on the lips or is stuck to the end wall 21 if a layer of adhesive is interposed between the disk and said end wall. Either way, the lips 223 prevent the disk 30 from subsequently escapsuleing from inside the insert 20.

Before or after inserting the disk 30 inside the insert 20, the insert is placed inside the cap 13 of the capsule 10, by being inserted axially under force from the open bottom end thereof. The tooling for performing this operation then advantageously folds the tongue 145 upwards so that it takes up its configuration shown in the right-hand portion of FIG. 2.

By holding the insert 20 stationary in this way inside the cap 13 of the capsule 10, the closure 40 is formed that is subsequently fitted onto the neck 2 by being screwed thereon until firstly the tongue 145 passes under the shoulder 8 of the neck, and secondly the sealing disk 30 is compressed axially between the rim 4 and the end wall 21 of the insert 20, the bottom face of the disk advantageously defining a hollow annular recess 31 that is substantially complementary to the rim. When the closure is fitted around the neck 2, the inside face 143B of the portion 143 of the skirt co-operates with the ring 6, in particular via the bead 147, by means of complementary shapes serving to center the sleeve 12 around the neck. The device 1 is then in the configuration shown in the right-hand portion of FIG. 2.

In this configuration, the skirt 14 covers the base of the neck 2, fitting closely thereabout since its portion 143 is in contact with the ring 6 while its bottom end 144 presses against the portion 7 of the neck.

Naturally, various arrangements and variations of the above-described closure device can be envisaged.

As examples:

level with the bearing zone of the end 144 of the skirt 14, the neck 2 of the receptacle 3 need not necessarily present an outside face having a conical shape that is opposite to the shape of the skirt 14 on being extracted from the mold; the neck could have a cylindrical outside face, or even an outside face that is frustoconical converging towards the axis X-X on going away from the rim 4, providing the angle at the apex of the skirt is greater than that of the elongate portion of the neck, so as to guarantee that when the closure device is put into place around the neck, the skirt is deformed sufficiently for its end 144 to press against the neck;

instead of providing a sealing disk 30 that is made as a single piece, it is possible to provide a sandwich structure comprising at least a bottom sealing layer together with an elastic top layer;

the sealing disk 30 could be replaced by a sealing washer of inside diameter substantially equal to or less than the inside diameter of the rim 4;

instead of or in addition to the means described above for holding the insert 20 stationary relative to the cap 13 of the capsule 10 by means of complementary shapes, the insert could be fitted permanently inside the capsule 10 by heat sealing, in particular by applying ultrasound, or by adhesive, or the like; and/or the neck of the receptacle on which the closure device 1 is put into place could be made of a plastics material.

The invention claimed is:

1. A closure device for closing a neck of a receptacle, the device comprising:

an outer capsule of a plastic material having a tubular sleeve with a longitudinal axis configured to be placed substantially in alignment with an axis of the neck; and an internal insert adapted to surround a thread on an outside face of the neck and to be releasably fitted around the outside of the neck, wherein the internal insert is open at a bottom end and closed at an opposing top end by an insert end wall, said sleeve including in one piece in succession along its axis:

a cap in which said internal insert is adapted to be inserted and to be held permanently stationary; and an end skirt integral with the cap and extending axially beyond said internal insert, said end skirt including a truncated cone converging towards the axis of said sleeve in a direction away from said cap when the closure device is in a fully closed position around the neck, wherein said truncated cone includes at its end remote from said cap, an inside surface adapted to bear against the neck of the receptacle under the action of elastic deformation of said sleeve resulting from the device being put into place around the neck, and wherein said truncated cone is deformed radially outward when the closure device is in the fully closed position around the neck.

2. The device according to claim 1, wherein the inside and outside diameters of said skirt level with said inside surface adapted to bear against the neck of the receptacle are less than the inside diameter and the outside diameter respectively of a portion of said skirt directed towards said cap.

3. The device according to claim 1, wherein a thickness of the wall of said truncated cone is substantially constant along its length.

4. The device according to claim 1, wherein said skirt includes a line of weakness designed to be broken on a first opening of the receptacle fitted with the closure device, and wherein said truncated cone includes a tongue projecting from the inside surface of the skirt and adapted to prevent a portion of said skirt overlying the neck from being removed when said line of weakness breaks, and, in its end portion directed towards said cap, internal centering means for centering said sleeve around the neck of the receptacle, the internal centering means being situated axially between said line of weakness and the surface where said truncated cone bears against the neck.

5. The device according to claim 4, wherein the centering means comprise at least one bead extending around the entire inside periphery of a top end portion of said skirt and adapted to bear in a leak tight manner against the neck of the receptacle.

6. The device according to claim 5, wherein the bead is disposed axially in the vicinity of said line of weakness.

7. The device according to claim 1, wherein the insert includes a plurality of longitudinal splines and the cap includes a plurality of longitudinal grooves formed in an inside face of the cap, and wherein the plurality of longitudinal splines engage with the plurality of longitudinal grooves.

8. The device according to claim 1, further comprising a sealing disk configured to be assembled within the internal insert, wherein the sealing disk is located between a rim of the neck and the internal insert when the closure device closes the neck of the receptacle.

9. The device according to claim 1, wherein a line of weakness is formed in the skirt and located between a closed end wall of the skirt and the end of the truncated cone remote from the cap.

10. The device according to claim 1, wherein a top end portion of the skirt includes a shoulder directed inwards relative to a bottom end of the cap.

11. The device according to claim 1, wherein the insert includes three spaced apart radially inwardly projecting lips distributed around the periphery of the skirt.

12. The device according to claim 1, wherein a top end portion of the truncated cone has an inner diameter that is substantially equal to a maximum outside diameter of a ring of the neck of the receptacle.

13. A receptacle having a neck closed by a closure device comprising:

an outer capsule of a plastic material having a tubular sleeve with a longitudinal axis configured to be placed substantially in alignment with an axis of the neck; and an internal insert adapted to surround a thread on an outside face of the neck and to be releasably fitted around the outside of the neck, wherein the internal insert is open at a bottom end and closed at an opposing top end by an insert end wall, said sleeve including in one piece in succession along its axis:

a cap in which said internal insert is adapted to be inserted and to be held permanently stationary; and an end skirt integral with the cap and extending axially beyond said internal insert, said end skirt including a truncated cone converging towards the axis of said sleeve in a direction away from said cap when the closure device is in a fully closed position around the neck, wherein said truncated cone includes at its end remote from said cap, an inside surface adapted to bear against the neck of the receptacle under the action of elastic deformation of said sleeve resulting from the device being put into place around the neck, and wherein said truncated cone is deformed radially outward when the closure device is in the fully closed position around the neck.

14. The receptacle of claim 13, wherein the receptacle is made of glass.

15. The receptacle of claim 13, wherein the closure device comprises a sealing disk configured to be assembled within the internal insert, wherein the sealing disk is located between a rim of the neck and the internal insert when the closure device closes the neck of the receptacle.

16. A method of closing the neck of a receptacle comprising:

obtaining a closure device including:

an outer capsule of a plastic material having a tubular sleeve with a longitudinal axis configured to be placed substantially in alignment with an axis of the neck; and an internal insert adapted to surround a thread on an outside face of the neck and to be releasably fitted around the outside of the neck, wherein the internal insert is open at a bottom end and closed at an opposing top end by an insert end wall, the sleeve including in one piece in succession along its axis:

a cap in which the internal insert is adapted to be inserted and to be held permanently stationary; and an end skirt integral with the cap and extending axially beyond the internal insert, the end skirt having a truncated cone converging towards the axis of the sleeve in a direction away from said cap when the closure device is in a fully closed position around the neck, wherein the truncated cone includes at its end remote from said cap, an inside surface adapted to bear against the neck of the receptacle under the action of elastic deformation of the sleeve resulting from the device being put into place around the neck;

placing the device around the neck of the receptacle; and deforming the sleeve elastically by pressing the inside surface of the end of the truncated cone that is remote from the cap against the neck of the receptacle, wherein said truncated cone is deformed radially outward when the closure device is in aali the fully closed position around the neck.

17. The method according to claim 16, wherein prior to placing the device around the neck of the receptacle, a tongue projecting from the inside surface of the skirt extends downwards towards the longitudinal axis, and wherein after the device is placed around the neck of the receptacle, the tongue extends upwards towards the longitudinal axis.

18. The method according to claim 16, wherein a sealing disk is placed inside the internal insert before the internal insert is inserted into the cap.

19. The method according to claim 18, wherein the neck of the receptacle includes a shoulder, a tongue projecting from the inside surface of the skirt passes under the shoulder, and the sealing disk is axially compressed between a rim of the neck and the insert end wall.

20. A method of manufacturing a closure device for closing a neck of a receptacle, comprising:

providing:

an outside capsule of a plastic material having a tubular sleeve with a longitudinal axis configured to be placed substantially in alignment with an axis of the neck; and an internal insert adapted to surround a thread on an outside face of the neck and to be fitted in releasable manner around the outside of the neck, wherein the internal insert is open at a bottom end and closed at an opposing top end by an insert end wall, said sleeve comprising, in one piece in succession along its axis, a cap for housing said insert and an end skirt integral with the cap; and inserting and permanently securing said insert in said cap of the sleeve, with said skirt extending axially beyond said insert, wherein said capsule is provided by molding the plastic material to form both said cap and said skirt of the sleeve, with said skirt being shaped as a truncated cone that converges towards the longitudinal axis of the sleeve in a direction away from said cap when the closure device is in a fully closed position around the neck and that presents, at an end remote from said cap, an inside surface adapted to press against the neck of the receptacle under the action of elastic deformation of said sleeve resulting from the device being put into place around the neck, wherein said truncated cone is deformed radially outward when the closure device is in the fully closed position around the neck.

* * * * *